US006202497B1

(12) United States Patent
Kuragaki et al.

(10) Patent No.: US 6,202,497 B1
(45) Date of Patent: Mar. 20, 2001

(54) SHIFT LEVER ASSEMBLY FOR AN ELECTRIC STARTER MOTOR

(75) Inventors: Akira Kuragaki; Shigeru Shiroyama, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/415,266

(22) Filed: Oct. 12, 1999

(30) Foreign Application Priority Data

Apr. 13, 1999 (JP) ..... 11-105068

(51) Int. Cl.[7] ..... F02N 11/00; F02N 15/06
(52) U.S. Cl. ..... 74/7 A; 74/6
(58) Field of Search ..... 74/7 A, 6; 290/38 R, 290/48

(56) References Cited

U.S. PATENT DOCUMENTS

| | | | | |
|---|---|---|---|---|
| 3,283,595 | * | 11/1966 | Inagaki | 74/7 A |
| 4,116,077 | * | 9/1978 | Mazzorana | 74/7 A |
| 4,294,129 | * | 10/1981 | Mazzorana | 74/7 A |
| 4,637,267 | * | 1/1987 | Mazzorana | 74/7 A |
| 4,779,470 | * | 10/1988 | Morita et al. | 74/7 A |

FOREIGN PATENT DOCUMENTS

| | | | | |
|---|---|---|---|---|
| 923883 | * | 7/1954 | (DE) | 74/7 A |
| 57-148058 | | 9/1982 | (JP) . | |

* cited by examiner

*Primary Examiner*—David A. Bucci
*Assistant Examiner*—William C Joyce
(74) *Attorney, Agent, or Firm*—Sughrue, Mion, Zinn, Macpeak & Seas, PLLC

(57) ABSTRACT

A shift lever assembly includes a shift lever having a fulcrum portion provided with a pair of pin bores for supporting portions of both ends of a pin, a first arm portion extending from one side of the fulcrum portion in a direction perpendicular to the axis of the pair of pin bores, a second arm portion for engaging the overrunning clutch extending from the other side of the fulcrum portion in a direction perpendicular to the axis of the pair of pin bores, and a housing recess formed from a root portion of the second arm portion across to the first arm portion so as to be open on one side in a direction perpendicular to both the axis of the pair of pin bores and the direction of extension of the first and second arm portions; and a lever spring housed within the housing recess such that a first end thereof is placed in contact with a surface at the tip of the first arm portion and a second end thereof is placed in contact with the floor of the housing recess at the end nearest to the root portion of the second arm portion, the spring being bent towards the floor of the housing recess and elastically held against the shift lever by the pin inserted into the pair of pin bores, and the first end thereof engaging a hook on the plunger.

2 Claims, 7 Drawing Sheets

SHIFT LEVER ASSEMBLY FOR AN ELECTRIC STARTER MOTOR

BACKGROUND OF THE INVENTION

1. Field of the Invention

The present invention relates to a shift lever assembly for application to an electric starter motor for starting an engine.

2. Description of the Related Art

An electric starter motor includes: a starter motor for generating a torque; a planetary reduction assembly for reducing and outputting the torque from the starter motor; an overrunning clutch spline-fitted onto an output shaft of the planetary reduction assembly; a pinion integrated with the overrunning clutch slidably disposed on the output shaft; and an electromagnetic switch for controlling the passage of current to the starter motor and for pushing the pinion together with the overrunning clutch towards a ring gear of an engine by means of a shift lever assembly.

FIG. 12 is an exploded perspective of a conventional shift lever assembly for an electric starter motor, such as that described in Japanese Patent Laid-Open No. 62-28311, for example.

In FIG. 12, the shift lever assembly 50 includes: a lever holder 51 for securing to a front bracket (not shown); a shift lever 53 rotatably supported in the lever holder 51 by means of a pivot pin 52; and a torsion coil spring 54 connected to the shift lever 53 and a hook on a magnetic switch (not shown) so as to be able to impart actuating torque to the shift lever 53, elastically deforming when subjected to a torsional torque above a predetermined value.

The shift lever 53 includes: a first arm 53*a* for engaging an overrunning clutch (not shown); a forked second arm 53*b* extending in the opposite direction from the first arm 53*a* for supporting portions of both ends of the pivot pin 52 in a pair of pin bores 53*d* on either side; and a bridge portion 53*c* connecting the forked portions of the second arm 53*b* in the vicinity of the pin bores 53*d*.

The torsion coil spring 54 includes: a coil portion 54*c* inserted with enough play so as not to contact the pivot pin 52; and first and second engaging arms 54*a* and 54*b* extending from the coil portion 54*c* in mutually opposite directions. The first engaging arm 54*a* engages with the rear surface of the first arm 53*a*.

The lever holder 51 has a pair of arm portions 51*a* and 51*b* for holding the shift lever 53 on either side, pin bores 51*c* and 51*d* for supporting both ends of the pivot pin 52 being disposed in the arm portions 51*a* and 51*b*. One pin bore 51*c* is formed with approximately the same diameter as the pivot pin 52, and the other pin bore 51*d* is formed with a smaller diameter than the pivot pin 52.

To assemble a shift lever assembly 50 constructed in this manner, the torsion coil spring 54 is mounted on the shift lever 53 by first supporting the outer circumference of the coil portion 54*c* of the torsion coil spring 54 against the front surface of the bridge portion 53*c*, then engaging the first engaging arm 54*a* against the rear surface of the first arm 53*a* while applying a predetermined torsional torque to the coil portion 54*c* as a set load, and additionally placing the second engaging arm 54*b* in contact with the rear surfaces of the forked second arm 53*b* so as to span the two.

Next, the shift lever 53 is inserted between the pair of arms 51*a* and 51*b* of the lever holder 51 such that the pin bores 53*d* and the pin bores 51*c* and 51*d* align. Then, the pivot pin 52 is inserted from the pin bore 51*c*, through the pin bores 53*d*, and pressed into the pin bore 51*d*, mounting the shift lever 53 to the lever holder 51 to complete assembly of the shift lever assembly 50.

Then, the shift lever assembly 50 is mounted to the electric starter motor by securing the lever holder 51 to the front bracket.

Because the conventional shift lever assembly for an electric starter motor is constructed in this manner, one problem has been that there are many parts and the shape of the parts is complex, making it difficult to reduce costs.

Because the pivot pin 52 has been prevented from dislodging by pressing the pivot pin 52 into the pin bore 51*d*, another problem has been that strict precision has been required in the diameter of the pin bore 51*d*, also making it difficult to reduce costs.

Yet another problem has been difficult assembly because of the need to apply torsional torque to the torsion coil spring 54 while mounting the torsion coil spring on the shift lever 53.

SUMMARY OF THE INVENTION

The present invention aims to solve the above problems and an object of the present invention is to provide a shift lever assembly for an electric starter motor enabling reductions in the number of parts, simplification of the shapes of the parts, reductions in cost, and improvements to assembly.

In order to achieve the above object, according to one aspect of the present invention, there is provided a shift lever assembly for an electric starter motor for transmitting the actuating force of a plunger of an electromagnetic switch to an overrunning clutch spline-fitted onto an output shaft driven by the rotation of a starter motor, the shift lever assembly including:

a shift lever having a fulcrum portion provided with a pair of pin bores for supporting portions of both ends of a pin, a first arm portion extending from one side of the fulcrum portion in a direction perpendicular to the axis of the pair of pin bores, a second arm portion for engaging the overrunning clutch extending from the other side of the fulcrum portion in a direction perpendicular to the axis of the pair of pin bores, and a housing recess formed from a root portion of the second arm portion across to the first arm portion so as to be open on one side in a direction perpendicular to both the axis of the pair of pin bores and the direction of extension of the first and second arm portions; and a lever spring housed within the housing recess such that a first end thereof is placed in contact with a surface at the tip of the first arm portion and a second end thereof is placed in contact with the floor of the housing recess at the end nearest to the root portion of the second arm portion, the lever spring being bent towards the floor of the housing recess and elastically held against the shift lever by the pin inserted into the pair of pin bores, and the first end thereof engaging a hook on the plunger.

DETAILED DESCRIPTION OF THE PREFERRED EMBODIMENTS

The preferred embodiments of the present invention will be explained below with reference to the drawings.

Embodiment 1

Figure 1:
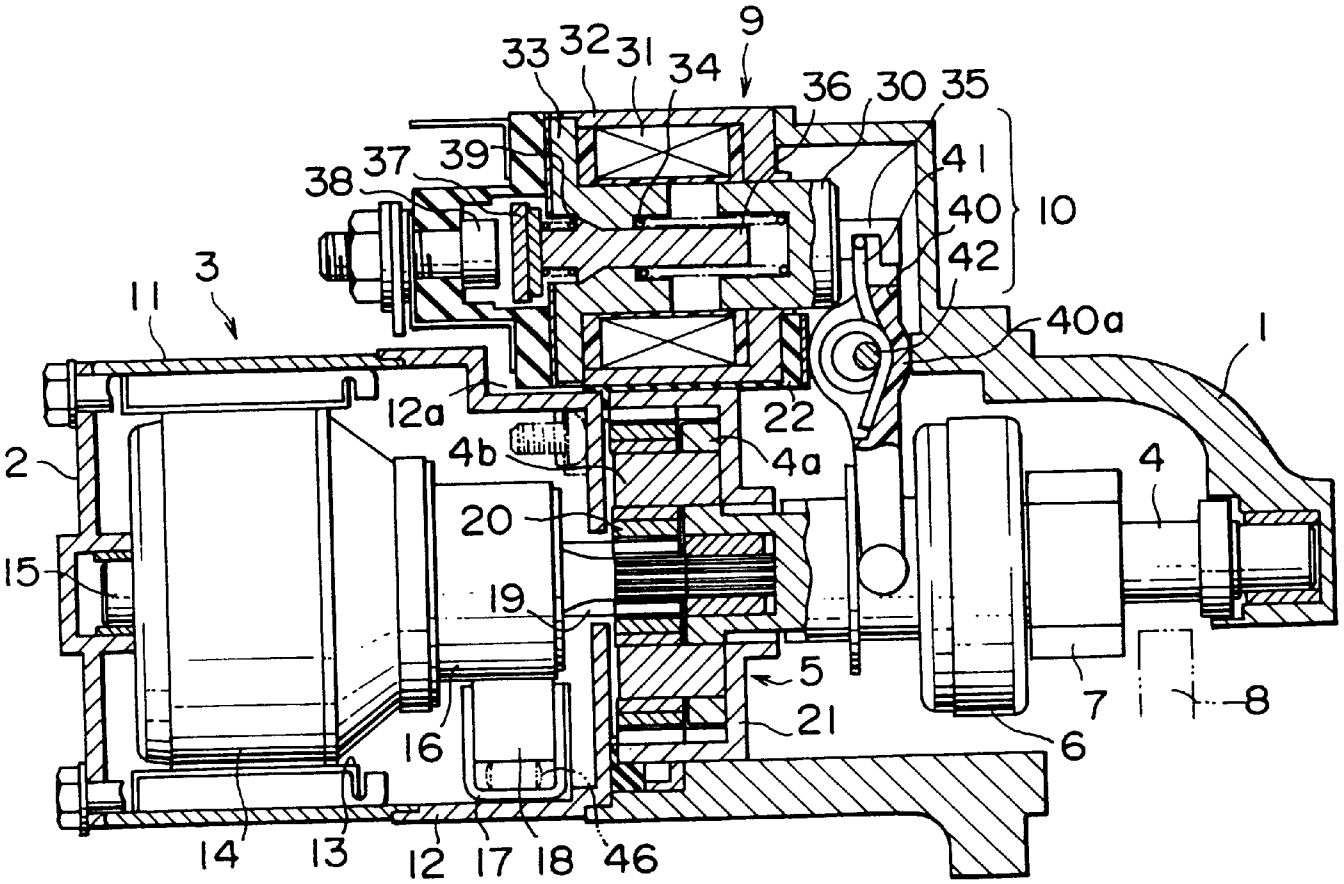
FIG. 1 is a partial cross-section of an electric starter motor according to Embodiment 1 of the present invention.

FIG. 1 is a partial cross-section of an electric starter motor according to Embodiment 1 of the present invention.

In FIG. 1, the electric starter motor includes: a starter motor 3 for generating torque; a planetary reduction assembly 5 for reducing and outputting the torque from the starter motor 3; an overrunning clutch 6 spline-fitted onto an output shaft 4 of the planetary reduction assembly 5; a pinion 7 integrated with the overrunning clutch 6 slidably disposed on the output shaft 4; and an electromagnetic switch 9 for controlling the passage of current to the starter motor 3 and for pushing the pinion 7 together with the overrunning clutch 6 towards a ring gear 8 of an engine by means of a shift lever assembly 10.

The starter motor 3 includes: a yoke 11 formed into a cylindrical shape as a case also functioning as an outer frame and a magnetic circuit; a center bracket 12 functioning as a case formed into a cylindrical shape having a bottom portion and joined to the yoke 11 by fitting the open end thereof over the circumference of the front end of the yoke 11; permanent magnets 13 disposed at even pitch circumferentially around the inner circumferential surface of the yoke 11; an armature 14 disposed radially inside the permanent magnets 13; a commutator 16 mounted on the end of a rotor shaft 15 nearest to the armature 14 (to the right in FIG. 1); and brushes 18 disposed so as to slide in contact with the commutator 16. A rear bracket 2 fits over the outer circumference of the rear end of the yoke 11, is joined to the yoke 11, and supports the rear end of the rotor shaft 15 (to the left in FIG. 1). Furthermore, a front bracket 1 fits over the outer circumference of the front end of the center bracket 12 and is joined to the center bracket 12.

The brushes 18 are disposed radially outside the commutator 16 disposed on the front end of the armature 14, being held in a slidable state by brush holders 17 and constantly pushed against the commutator 16 by brush springs 46.

The commutator 16 and the brush holders 17 are disposed within the center bracket 12. The front end of the rotor shaft 15 extends through an aperture disposed in the center of the bottom portion of the center bracket 12.

Here, part of the outer circumferential wall of the center bracket 12 is modified to form an arc-shaped recess 12*a* indented into a clear space between the brushes 18. Furthermore, a notch is formed in the outer circumferential wall of the rear end side of the front bracket 1, so as to fit continuously with the arc-shaped recess formed in the center bracket 12.

The planetary reduction assembly 5 includes: a sun gear 19 formed on the outer circumference of the front end of the rotor shaft 15; a plurality of planet gears 20 meshing with the sun gear 19; and an internal gear 21 meshing with each of the planet gears 20. The sun gear 19 transmits the rotation of the rotor shaft 15 to each of the planet gears 20 by rotating together with the rotor shaft 15. The planet gears 20 are supported by an outer 4*a* formed on the rear end of the output shaft 4 so as to be able to rotate freely by means of pins 4*b* secured to the outer 4*a*, and revolve around the outer circumference of the sun gear 19 while rotating when subjected to the rotation of the sun gear 19. The internal gear 21 is prevented from rotating by the front bracket 1. The rear end of the output shaft 4 fits over the front end of the rotor shaft 15 so as to rotate freely, and the front end thereof is supported by the front bracket 1.

The overrunning clutch 6 is spline-fitted onto the output shaft 4 so as to be able to move in the axial direction and such that rotary motion is transmitted thereto. The shift lever assembly 10 is mounted so as to be able to rotate about an intermediate fulcrum portion 40*a*, a first end connected to a plunger 30 of an electromagnetic switch 9 mounted in an upper portion of the starter motor 3 and a second end engaging the overrunning clutch 6. Furthermore, packing 22 is fitted into the notch formed in the front bracket 1 so as to support the fulcrum portion 40*a* of the shift lever assembly 10.

The lower side of the electromagnetic switch 9 is accommodated in the arc-shaped recess 12*a* formed in the center bracket 12, positioned radially outside the starter motor 3 and the planetary reduction assembly 5, the central axis thereof being disposed generally parallel to the output shaft 4. Here, the front end of the electromagnetic switch 9 is accommodated in the notch formed in the front bracket by means of the packing 22. The electromagnetic switch 9 includes: a switch coil 31 for generating a magnetic force by being applied an electric current thereto; a frame 32 covering the outside of the switch coil 31 and forming part of a magnetic circuit; a core 33 disposed within the rear end of the switch coil 31 and forming part of the magnetic circuit; a plunger 30 disposed within the switch coil 31 so as to be able to slide freely in the axial direction; a return spring 34 disposed between the core 33 and the plunger 30 to constantly push the plunger 30 towards the front (towards the left in FIG. 1); a hook 35 disposed at the front end of the plunger 30; a rod 36 disposed at the axial center of the core 33 so as to be able to slide freely in the axial direction; a movable contact 37 mounted on the rear end of the rod 36 for opening and closing the electric current circuit to the starter motor 3; and a pair of fixed contacts 38 disposed opposite the movable contact 37 forming connections to external wiring.

The hook 35 engages a first end of a lever spring 41 of the shift lever assembly 10. Furthermore, the rod 36 is constantly pushed towards the front by a spring (not shown).

Figure 2:
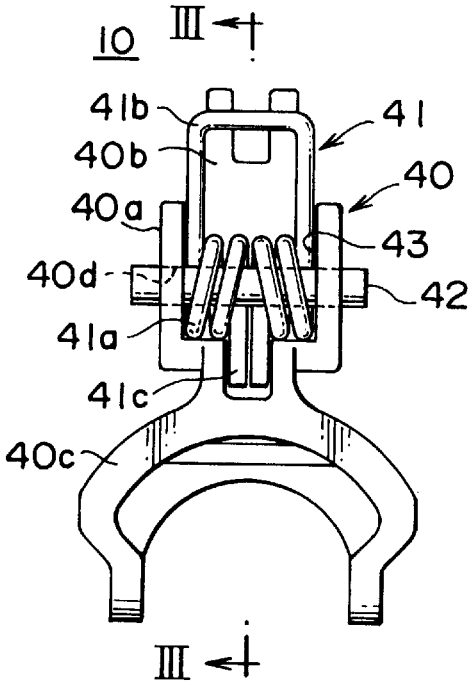
FIG. 2 is a rear elevation of a shift lever assembly for the electric starter motor according to Embodiment 1 of the present invention.
Figure 3:
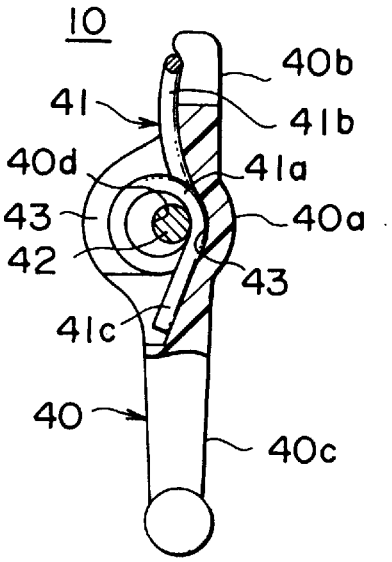
FIG. 3 is a cross-section taken along line III—III in FIG. 2 viewed from the direction of the arrows.

Next, the construction of the shift lever assembly 10 will be explained with reference to FIGS. 2 and 3.

The shift lever assembly 10 includes: a shift lever 40 supported on the front bracket 1 by the packing 22; a lever spring 41 for connecting the shift lever 40 to the hook 35 of the plunger 30 so as to enable an actuating torque to be applied to the shift lever 40, elastically deforming when subjected to torque above a predetermined value; and a pin 42 for elastically supporting the lever spring 41 on the shift lever 40.

The shift lever 40 is composed of a resin such as nylon or the like, and includes: a fulcrum portion 40*a* provided with a pair of pin bores 40*d* for supporting portions of both ends of the pin 42; a first arm portion 40*b* extending from one side of the fulcrum portion 40*a* in a direction perpendicular to the axis of the pin bores 40*d*; and a forked second arm portion 40*c* for engaging the overrunning clutch 6 extending from the other side of the fulcrum portion 40*a* in the direction opposite to the first arm portion 40*b*. A housing recess 43 for housing the lever spring 41 is formed in the shift lever 40 from a root portion of the second arm portion 40*c* across to the first arm portion 40*b* so as to be open on the rear surface side (left side in FIG. 3). Moreover, the rear surface corresponds to a plane facing in a direction perpendicular to both the axis of the pin bores 40*d* and the direction of extension of the first arm portion 40*b* and the second arm portion 40*c*.

The lever spring 41 consists of a coil spring and includes a coil portion 41*a* elastically supported on the pin 42, and first and second engaging arms 41*b* and 41*c* extending in mutually opposite directions from the coil portion 41*a*.

Here, the pin bores 40*d* are disposed in positions where the distance between the pin bores 40*d* and the floor 43*a* of the housing recess 43 is greater than the diameter of the wire of the coil spring 41, and the diameter of the pin bores 40*d* is greater than the diameter of the pin 42. Furthermore, the floor 43*a* of the housing recess 43 is formed such that when the lever spring 41 is housed in the housing recess 43 and elastically supported on the pin 42, the floor 43*a* is only in contact with the tip of the first engaging arm 41*b* and the tip of the second engaging arm 41*c*.

Figure 4:
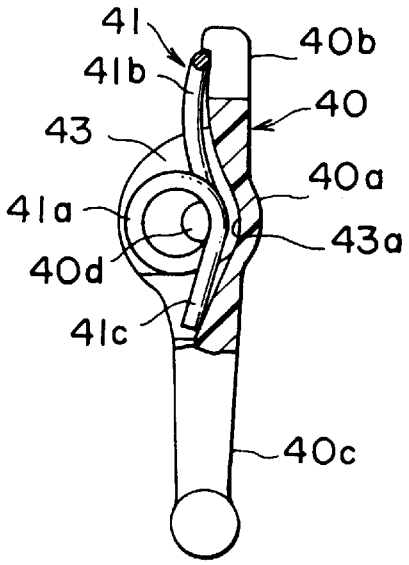
FIG. 4 is a partial cross-section explaining the method of assembling the shift lever assembly for the electric starter motor according to Embodiment 1 of the present invention.
Figure 5:
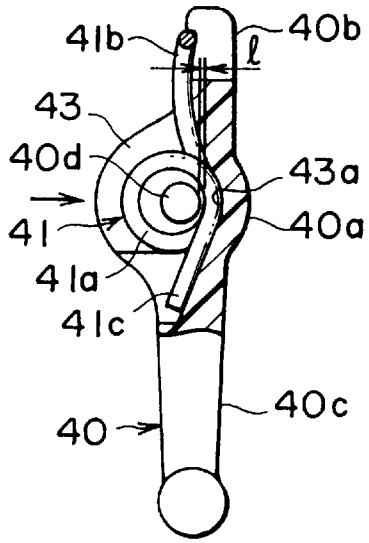
FIG. 5 is a partial cross-section explaining the method of assembling the shift lever assembly for the electric starter motor according to Embodiment 1 of the present invention.

To assemble this shift lever assembly 10, first the lever spring 41 is inserted inside the housing recess 43, as shown in FIG. 4. At this point, the tip of the first engaging arm 41*b* of the lever spring 41 is in contact with the rear surface of the tip of the first arm 40*b* portion, and the tip of the second engaging arm 41*c* of the lever spring 41 is in contact with the floor 43*a* of the housing recess 43, and no other portion of the lever spring 41 is in contact with the floor 43*a*. Then, as indicated by the arrow in FIG. 5, pressure is applied to the coil portion 41*a* until the outer circumferential surface thereof comes into contact with the floor 43*a*. At this point, the lever spring 41 pivots about both ends and is elastically deformed so as to bend to the right in FIG. 4, giving rise to a clearance L between the pin bores 40*d* and the inner circumferential surface of the coil portion 41*a*, as shown in FIG. 5. Next, the pin 42 is inserted into the pin bores 40*d* and then the pressure on the coil portion 41*a* is released. Thus, the lever spring 41 returns to alleviate the bending and the inner circumferential surface of the coil portion 41*a* comes into contact with the pin 42. The lever spring 41 is thereby elastically supported on the shift lever 40 such that the tip of the first engaging arm 41*b* is placed in contact with the rear surface of the tip of the first arm portion 40*b*, and the tip of the second engaging arm 41*c* is placed in contact with the floor 43*a* of the housing recess 43 on the side nearest to the root of the second arm portion 40*c*, and no other portion is in contact with the floor 43*a*, as shown in FIG. 3. The pin 42 is placed in contact with the inner walls of the pin bores 40*d* by the restoring force of the lever spring 41, preventing dislodgment thereof.

Figure 6:
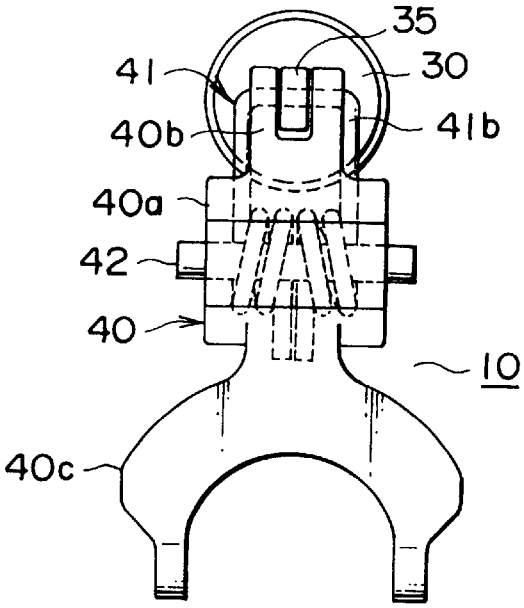
FIG. 6 is a front elevation showing the shift lever assembly for the electric starter motor according to Embodiment 1 of the present invention when mounted.
Figure 7:
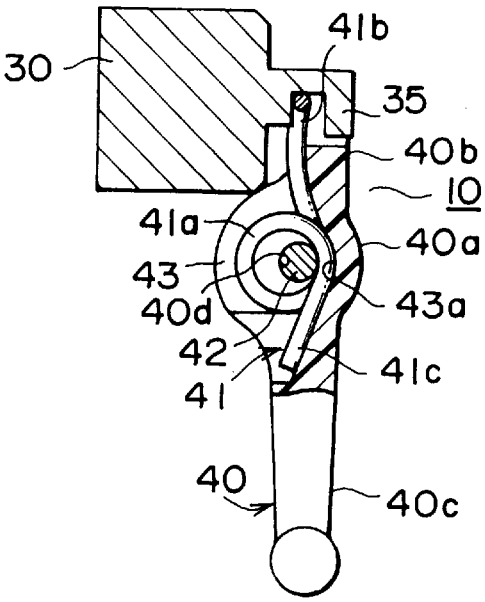
FIG. 7 is a partial cross-section showing the shift lever assembly for the electric starter motor according to Embodiment 1 of the present invention when mounted.

As shown in FIGS. 6 and 7, this shift lever assembly 10 is installed in an electric starter motor such that the hook 35 of the plunger 30 is positioned in a notch formed on the tip of the first arm portion 40*b* of the shift lever 40. Thus, when the electromagnetic switch 9 operates and the plunger 30 moves towards the left in FIG. 7, the hook 35 engages the tip of the first engaging arm 41*b* of the lever spring 41.

Next, the operation of the electric starter motor constructed in this manner will be explained.

When a key switch (not shown) is closed, current flows through the switch coil 31, whereby the plunger 30 is subjected to the magnetic force generated by the switch coil 31 and is attracted to the core 33. Consequently, the plunger 30 moves towards the rear (towards the left in FIG. 1) against the pushing force of the return spring 34. With the movement of the plunger 30, the hook 35 moves to the rear side. Then, the hook 35 engages the tip of the first engaging arm 41*b* of the lever spring 41 of the shift lever assembly 10, and the shift lever 40 rotates counterclockwise in FIG. 1 about the fulcrum portion 40*a*. The overrunning clutch 6 is pressed by the shift lever 40 as it rotates, whereby the overrunning clutch 6 and the pinion 7 move together on the output shaft 4 towards the front (towards the right in FIG. 1). When the end surface of the pinion 7 comes into contact with the end surface of the ring gear 8, the movement of the overrunning clutch 6 and the pinion 7 ceases, but the plunger 30 is attracted and moves further while bending (elastically deforming) the lever spring 41 and comes into contact with the rod 36. Then, after the movable contact 37 has come into contact with the fixed contacts 38, the plunger 30 moves and presses the rod 36 further while compressing a spring 39, and stops moving when the end surface of the plunger 30 reaches the end surface of the core 33. At this point, the repulsion of the elastically deformed lever spring 41 is acting on the overrunning clutch 6 by means of the second arm portion 40*c* of the shift lever 40 and is pushing the overrunning clutch 6 towards the front.

When the movable contact 37 contacts the fixed contacts 38, current flows through the brushes 18 and the commutator 16 to the armature 14, and the armature 14 rotates. The rotational torque of the armature 14 is transmitted to the output shaft 4 by means of the planetary reduction assembly 5 and the output shaft 4 rotates. At this point, the rotation of the armature 14 is reduced by the planetary reduction assembly 5 and transmitted to the output shaft 4.

With the rotation of the output shaft 4, the pinion 7 also rotates, and when the contact position of the pinion 7 shifts to a position relative to the ring gear 8 where meshing is possible, the overrunning clutch 6 and the pinion 7 are pushed out towards the front by the pushing force of the lever spring 41, and the pinion 7 meshes with the ring gear 8. In this manner, the rotational torque of the output shaft 4 is transmitted to the ring gear 8, and the engine is driven.

When the engine has been ignited and the key switch is switched off, the flow of electricity to the switch coil 31 ceases. Then, the plunger 30 is returned towards the front by the pushing force of the return spring 34 to the state shown in FIG. 1.

According to Embodiment 1, the lever spring 41 can be installed in the shift lever 40 by housing the lever spring 41 in the housing recess 43, pressing the coil portion 41*a* towards the floor 43*a*, inserting the pin 42 into the pin bores

40*d*, then releasing the pressure on the coil portion 41*a* in this manner. Thus, because with this shift lever assembly 10 there is no longer any need to apply torsional torque when installing the coil spring as there was in a conventional device, assembly is improved.

Furthermore, because the shift lever assembly 10 includes only three parts, namely, the shift lever 40, the lever spring 41, and the pin 42, the number of parts is reduced compared to a conventional device, enabling costs to be reduced.

Because the shapes of the component parts is simplified compared to a conventional device, manufacturing is facilitated and costs can be reduced.

Because there is no need to press fit the pin 42 into the pin bores 40*d*, the pin bores 40*d* do not need to be machined with high precision, enabling costs to be reduced.

Furthermore, because the shift lever 40 is composed of resin, there is no need to consider leakage of the magnetic flux generated by the electromagnetic switch 9.

Embodiment 2

Figure 8:
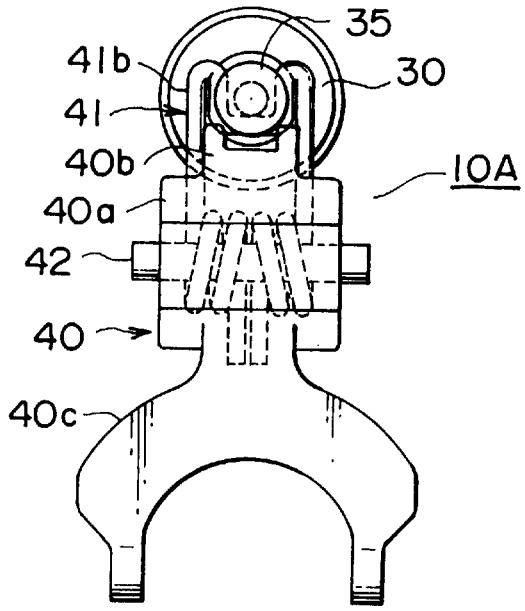
FIG. 8 is a front elevation showing a shift lever assembly for an electric starter motor according to Embodiment 2 of the present invention when mounted.
Figure 9:
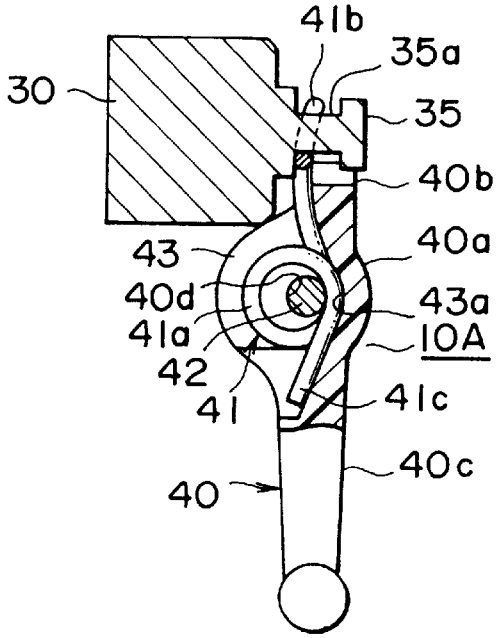
FIG. 9 is a partial cross-section showing the shift lever assembly for the electric starter motor according to Embodiment 2 of the present invention when mounted.

FIGS. 8 and 9 are a front elevation and a partial cross-section, respectively, showing a shift lever assembly according to Embodiment 2 of the present invention when installed in an electric starter motor.

In FIGS. 8 and 9, the first arm portion 40*b* of the shift lever 40 is formed such that the length of extension thereof from the fulcrum portion 40*a* is short. Furthermore, the tip of the first engaging arm 41*b* of the lever spring 41 is formed into a U-shape. In addition, a small-diameter portion 35*a* is formed on the hook 35.

The shift lever assembly 10A is installed such that the small-diameter portion 35*a* of the hook 35 is inserted into the U-shaped portion of the first engaging arm 41*b* extending from the first arm portion 40*b*.

Moreover, the rest of the construction is the same as for Embodiment 1.

In this shift lever assembly 10A, because the small-diameter portion 35*a* of the hook 35 is inserted into the U-shaped portion of the first engaging arm 41*b* extending from the first arm portion 40*b*, the hook 35 engages the first engaging arm 41*b* due to the movement of the plunger 30 and operates in the same manner as the shift lever assembly 10 according to Embodiment 1 above.

Furthermore, because the shift lever assembly 10A is constructed in the same manner as the shift lever assembly 10 according to Embodiment 1 above except that the length of extension of the first arm portion 40*b* from the fulcrum portion 40*a* is shorter and the tip of the first engaging arm 41*b* of the lever spring 41 is formed into a U-shape, the same effects as Embodiment 1 above are exhibited.

Embodiment 3

Figure 10:
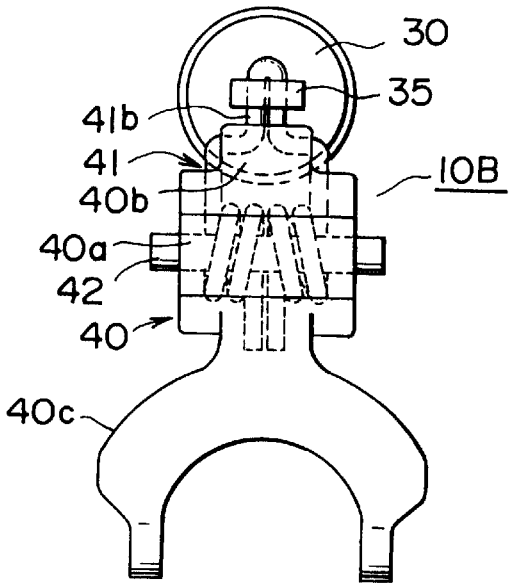
FIG. 10 is a front elevation showing a shift lever assembly for an electric starter motor according to Embodiment 3 of the present invention when mounted.
Figure 11:
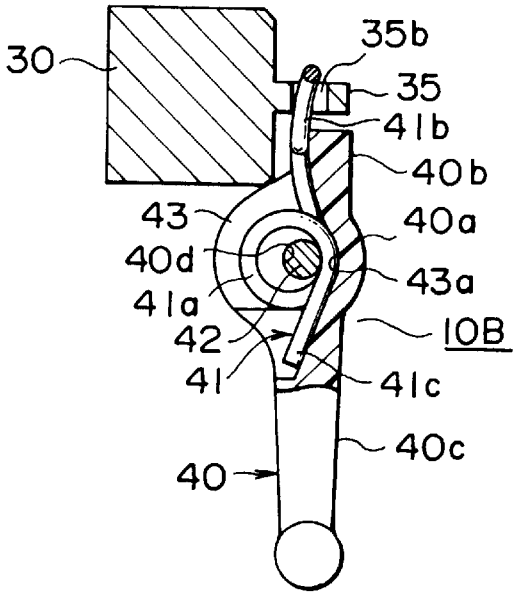
FIG. 11 is a partial cross-section showing the shift lever assembly for the electric starter motor according to Embodiment 3 of the present invention when mounted.
Figure 12:
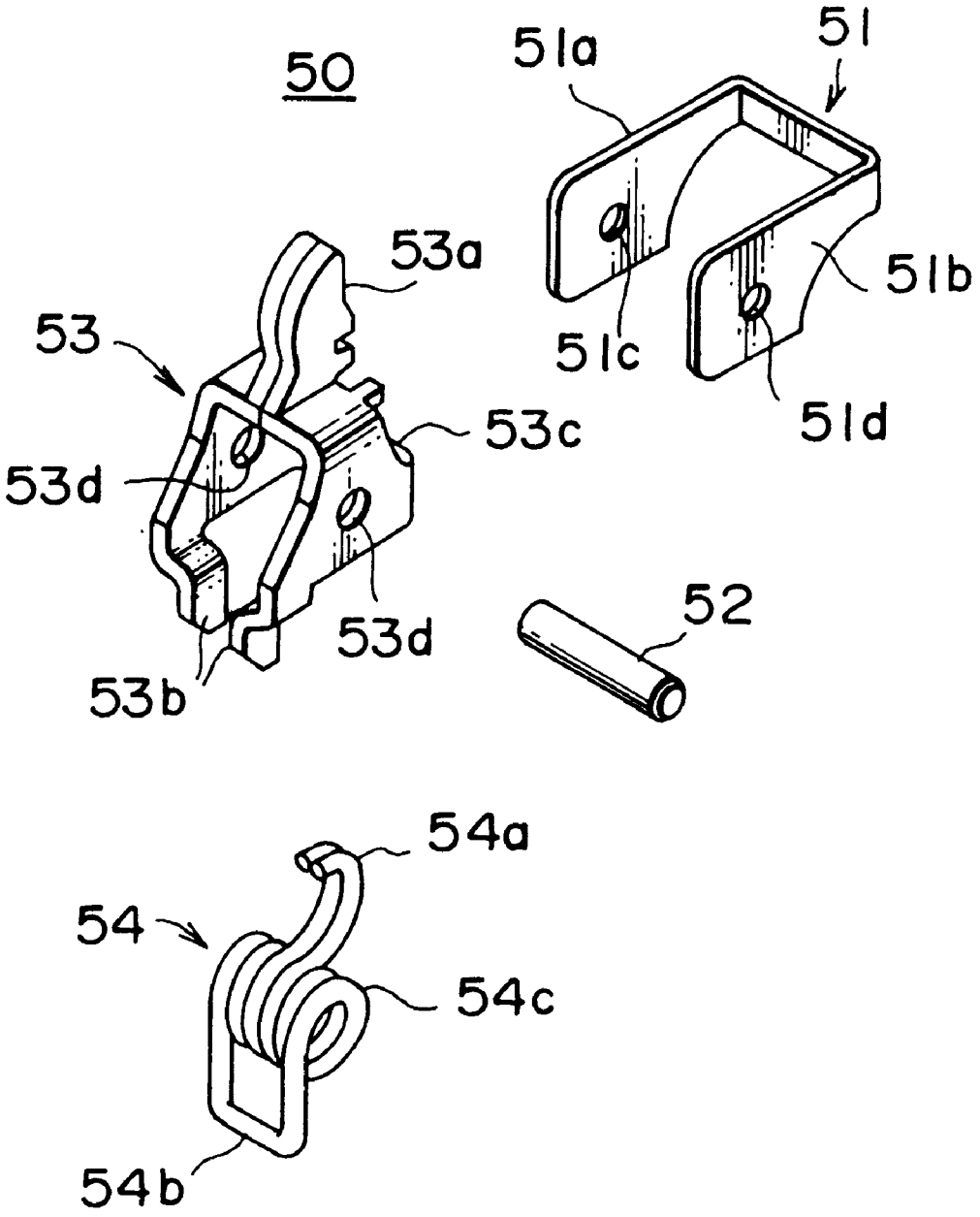
FIG. 12 PRIOR ART
FIG. 12 is an exploded perspective of a conventional shift lever assembly for an electric starter motor.

FIGS. 10 and 11 are a front elevation and a partial cross-section, respectively, showing a shift lever assembly according to Embodiment 3 of the present invention when installed in an electric starter motor.

In FIGS. 10 and 11, the first arm portion 40*b* of the shift lever 40 is formed such that the length of extension thereof from the fulcrum portion 40*a* is short. Furthermore, the tip of the first engaging arm 41*b* of the lever spring 41 is formed into a I-shape. In addition, a slot 35*b* is formed in the hook 35.

The shift lever assembly 10B is installed such that the I-shaped portion of the first engaging arm 41*b* extending from the first arm portion 40*b* is inserted into the slot 35*b* of the hook 35.

Moreover, the rest of the construction is the same as for Embodiment 1.

In this shift lever assembly 10B, because the I-shaped portion of the first engaging arm 41*b* extending from the first arm portion 40*b* is inserted into the slot 35*b* of the hook 35, the hook 35 engages the first engaging arm 41*b* due to the movement of the plunger 30 and operates in the same manner as the shift lever assembly 10 according to Embodiment 1 above.

Furthermore, because the shift lever assembly 10B is constructed in the same manner as the shift lever assembly 10 according to Embodiment 1 above except that the length of extension of the first arm portion 40*b* from the fulcrum portion 40*a* is shorter and the tip of the first engaging arm 41*b* of the lever spring 41 is formed into a I-shape, the same effects as Embodiment 1 above are exhibited.

Moreover, in each of the above embodiments, the lever spring 41 is given to be constituted by a coil spring, but the lever spring is not limited to a coil spring and may be constituted by any object producing elastic deformation when subjected to torque above a predetermined value, such as a leaf spring, for example.

Because the present invention is constructed in the above manner, it exhibits the effects described below.

In the shift lever assembly according to the present invention, there is provided a shift lever assembly for an electric starter motor for transmitting the actuating force of a plunger of a magnetic switch to an overrunning clutch spline-fitted onto an output shaft driven by the rotation of a starter motor, the shift lever assembly including:

a shift lever having a fulcrum portion provided with a pair of pin bores for supporting portions of both ends of a pin, a first arm portion extending from one side of the fulcrum portion in a direction perpendicular to the axis of the pair of pin bores, a second arm portion for engaging the overrunning clutch extending from the other side of the fulcrum portion in a direction perpendicular to the axis of the pair of pin bores, and a housing recess formed from a root portion of the second arm portion across to the first arm portion so as to be open on one side in a direction perpendicular to both the axis of the pair of pin bores and the direction of extension of the first and second arm portions; and a lever spring housed within the housing recess such that a first end thereof is placed in contact with a surface at the tip of the first arm portion and a second end thereof is placed in contact with the floor of the housing recess at the end nearest to the root portion of the second arm portion, the spring being bent towards the floor of the housing recess and elastically held against the shift lever by the pin inserted into the pair of pin bores, the first end thereof engaging a hook on the plunger, thereby providing a shift lever assembly for an electric starter motor enabling a reduction in the number of parts, simplification of the shapes of the parts, a reduction in costs, and improved assembly.

Because the shift lever is composed of resin, there is no longer any need to consider leakages of the magnetic flux generated in the magnetic switch.

What is claimed is:

1. An electric starter motor shift lever assembly for transmitting the actuating force of a plunger of an electromagnetic switch to an overrunning clutch spline-fitted onto an output shaft driven by the rotation of a starter motor, said shift lever assembly comprising:

a shift lever having a fulcrum portion provided with a pair of pin bores for supporting portions of both ends of a pin, a first arm portion extending from one side of said fulcrum portion in a direction perpendicular to the axis of said pair of pin bores, a second arm portion for engaging said overrunning clutch extending from the other side of said fulcrum portion in a direction perpendicular to the axis of said pair of pin bores, and a housing recess formed from a root portion of said second arm portion across to said first arm portion so as to be open on one side in a direction perpendicular to both the axis of said pair of pin bores and the direction of extension of said first and second arm portions; and a lever spring housed within said housing recess such that a first end thereof is placed in contact with a surface at the tip of said first arm portion and a second end thereof is placed in contact with a floor of said housing recess at the end nearest to said root portion of said second arm portion, said lever spring being bent towards said floor of said housing recess and elastically held against said shift lever by said pin inserted into said pair of pin bores, and said first end thereof configured to engage a hook on said plunger.

2. The electric starter motor shift lever assembly according to claim 1 wherein said shift lever is composed of resin.

* * * * *